US007043800B2

(12) United States Patent
Moody

(10) Patent No.: US 7,043,800 B2
(45) **Date of Patent: *May 16, 2006**

(54) SANITARY DOOR OPENER

(76) Inventor: Charles Moody, 751 Kentland Dr., Great Falls, VA (US) 22066

( * ) Notice: Subject to any disclaimer, the term of this patent is extended or adjusted under 35 U.S.C. 154(b) by 20 days.

This patent is subject to a terminal disclaimer.

(21) Appl. No.: 10/837,678

(22) Filed: May 4, 2004

(65) Prior Publication Data

US 2005/0005402 A1 Jan. 13, 2005

Related U.S. Application Data

(63) Continuation-in-part of application No. 10/602,864, filed on Jun. 25, 2003.

(51) Int. Cl.
*E05B 1/00* (2006.01)
*A45C 13/22* (2006.01)

(52) U.S. Cl. ..... 16/412; 16/413; 16/901

(58) Field of Classification Search ..... 16/413, 16/412, 402, 82, 83, DIG. 2; 292/288, 289; D8/300, 307, 314, DIG. 1; 49/263, 264, 49/266, 273, 274, 404; 312/319.9, 326, 139
See application file for complete search history.

(56) References Cited

U.S. PATENT DOCUMENTS 1,583,818 A * 5/1926 White ..... 292/171
2,447,389 A * 8/1948 Borchers ..... 16/413
3,514,904 A * 6/1970 Riegelman ..... 49/460
4,710,634 A * 12/1987 Brookes ..... 250/455.11
4,817,239 A * 4/1989 Campbell ..... 16/413
5,379,821 A * 1/1995 Pergolizzi et al. ..... 160/371
5,412,839 A * 5/1995 McCollom ..... 16/430
6,382,750 B1 * 5/2002 King ..... 312/319.9

FOREIGN PATENT DOCUMENTS

AU 200064114 A * 4/2001
DE 4231798 A1 * 3/1994
KR 2004106671 A * 12/2004

* cited by examiner

*Primary Examiner*—Chuck Y. Mah
(74) *Attorney, Agent, or Firm*—Peter A. Borsari

(57) ABSTRACT

A sanitary door opener in the form of an attachment to the bottom of a conventional door enables a user to pull open the door by engaging the attachment with his/her foot or shoe, thereby preventing hand contact with the door opener. The sanitary door opener preferably is manufactured from a single piece of durable and flexible metal material and is bent to form a front face, a bottom face, a rear face, a top face extending outwardly from the rear face, and a lip extending downwardly from the top face. The door opener is installed easily to a door by sliding the door opener under a door such that the front face contacts the front panel of the door, the bottom face contacts the bottom edge of the door and the rear face contacts the rear panel of the door. Once installed in the desired position, the door opener is secured to the door by mounting the front face to the door's front panel and the rear face to the door's rear panel.

20 Claims, 4 Drawing Sheets

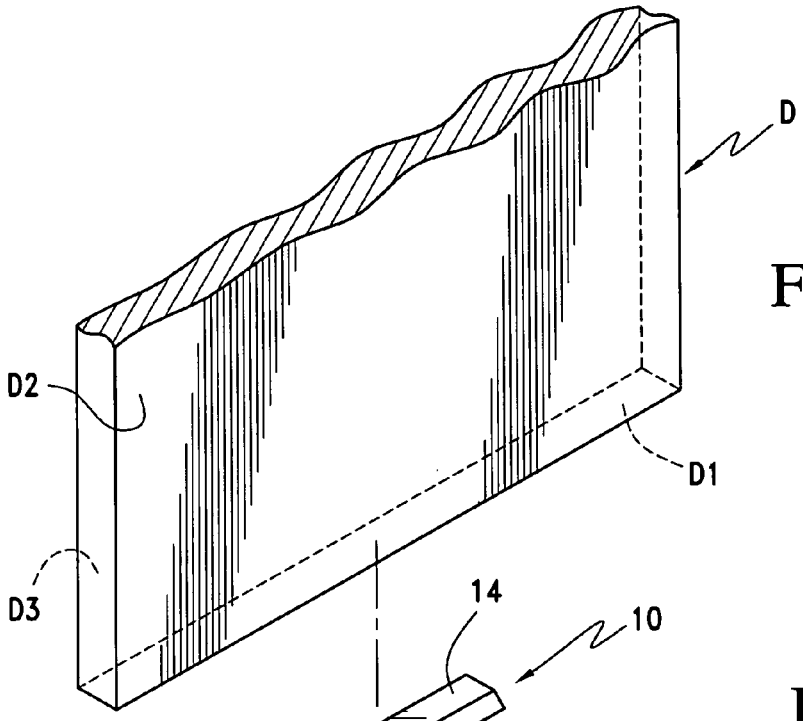
FIG. 1
FIG. 2
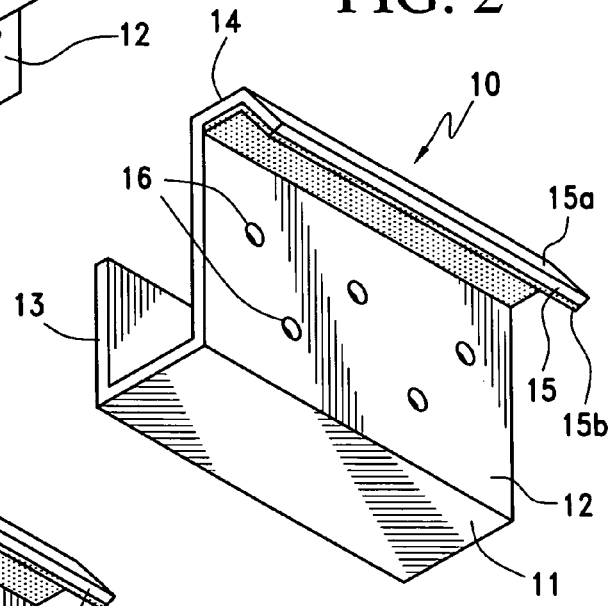
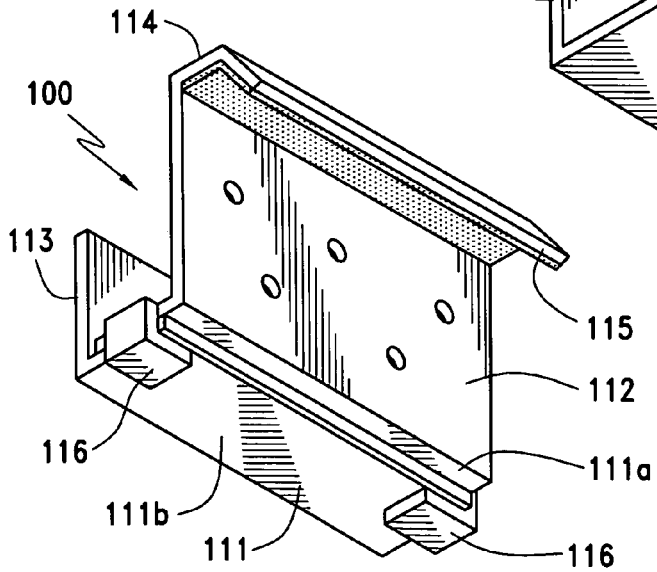
FIG. 3

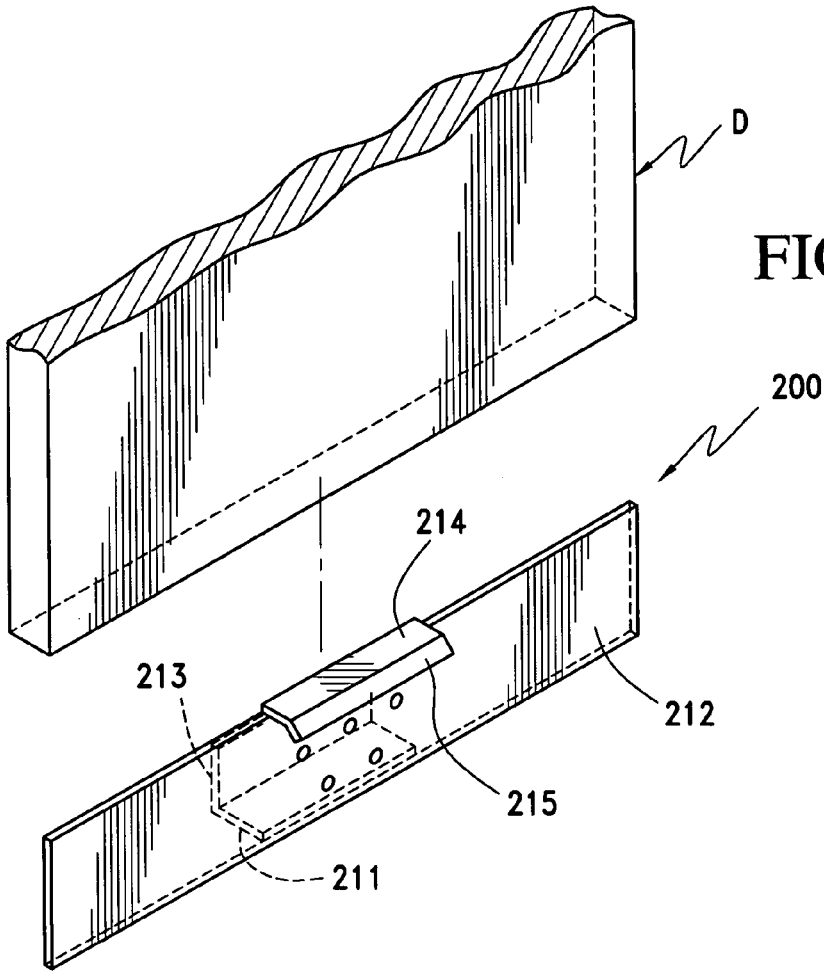
FIG. 4
FIG. 5
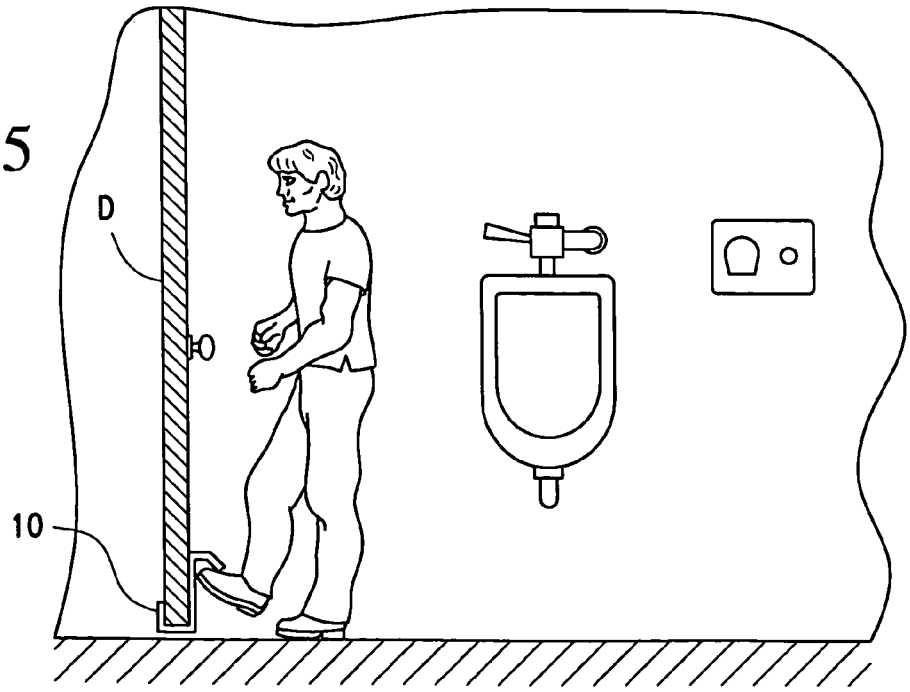

SANITARY DOOR OPENER

RELATED APPLICATION

This application is a continuation-in-part of U.S. patent application Ser. No. 10/602,864, filed in the United States Patent & Trademark Office on Jun. 25, 2003 and claims the benefit of priority therefrom.

FIELD OF INVENTION

The present invention relates to a sanitary door opener and in particular relates to an attachment for a conventional door which enables a user to pull open the door by engaging the attachment with his/her foot.

BACKGROUND OF THE INVENTION

Hand-operated devices, such as door knobs, handles and hand pulls, are well known in the prior art for opening doors. Although these devices are easy to use, they are susceptible to unsanitary conditions due to contamination by many substances, including harmful bacteria and other germs. Once contaminated, usually by transfer from people's hands, these hand-operated devices become a perfect vehicle for transmitting harmful contaminants to other people by hand contact. Typically, most unsanitary door openers are found in public places, such as public restrooms.

Several attempts have been made in the prior art to develop sanitary door handles. For example, U.S. Pat. No. 4,817,239 to Campbell et al., issued Apr. 4, 1989, provides a sanitary door opening assembly in the form of a U-shaped bracket which is disposed about the outer side edge of a door and a hook mounted to one surface of the bracket. The hook is adapted to receive a human forearm to pull the door open. In U.S. Pat. No. 6,289,557 to Manson et al., issued Sep. 18, 2001, another sanitary door handle assembly is disclosed, also having a hook-like handle which is mounted to the face of the door such that the forearm of a person can engage the hook like handle in order to open the door. One disadvantage of such door hooks is that pulling open a door with one's elbow can cause discomfort. Further, the position of such a door hook allows a person to grab the door hook with his/her hand, thereby contaminating the door hook. Once contaminated, a person can transfer contaminants to his/her body, particularly when the elbow or forearm is not covered by clothing.

A less elaborate door opener mounted to the side of a door is disclosed in U.S. Pat. No. 3,391,674 to Burleigh, issued Jul. 9, 1968. Burleigh provides an animal operated door opening device in the form of a Z-bent sheet metal plate having a central portion, an outer lateral panel and an inner securement flange which is mounted to the side of a door at a position where an animal's snout can contact the lower free corner of the outer lateral panel. The same drawbacks discussed with respect to the Campbell and Manson patents are found in Burleigh's animal-operated door opener.

Door openers which do not utilize a person's hand or arm have been described in the prior art. For example, U.S. Pat. No. 642,661 to Adams, issued Feb. 6, 1900, U.S. Pat. No. 842,081 to Clark, issued Jan. 22, 1907 and U.S. Pat. No. 1,337,384 to Allen, issued Apr. 20, 1920 to Allen, all disclose simple hooks screw-mounted to the bottom of a screen door which allow the door to be opened by a person's foot. An inherent defect in these door openers is that they are capable only of opening light-weight doors. The screw mounted hooks are not of sufficient strength to open heavy doors, such as public bathroom doors. In addition, such simple hooks do not allow an adult foot to sufficiently engage the hook to open a heavier styled door.

Despite the efforts of the prior art, a need still exists for a sanitary door opener which can be operated without contact by a person's hand or arm. Such a sanitary door opener should be adapted for operation by a person's foot. In addition, such a sanitary door opener should be designed to flex and create tension between the user's shoe and the opener. Moreover, such a sanitary door opener should be of sufficient strength to open all types of doors, including heavy doors such as public restroom doors. Further, such a sanitary door opener should be inexpensive to manufacture, simple to install and easy to use.

SUMMARY OF THE INVENTION

Accordingly, it is an object of the present invention to provide a sanitary door opener which is operated by a person's foot, preferably a foot inside a shoe.

It is another object of the present invention to provide a sanitary door opener which does not operate by contact with a person's hand or arm.

It is an additional object of the present invention to provide a sanitary door opener which can be installed on all types of doors.

It is a further object of the present invention to provide a sanitary door opener which is sufficient strength to open heavy doors including public restroom doors.

It is also an object of the present invention to provide a sanitary door opener which is designed to flex and create tension between the user's shoe and the opener.

It is yet another object of the present invention to provide a sanitary door opener which is inexpensive to manufacture, simple to install and easy to use.

Additional objects, advantages and novel features of the invention will be set forth in part of the description which follows, and in part will become apparent to those skilled in the art upon examination of the following specification or may be learned by practice of the invention.

BRIEF DESCRIPTION OF THE DRAWINGS

The present invention will be better understood with reference to the appended drawing sheets, wherein:

FIG. 1 is an exploded view of the bottom of a door and the sanitary door opener of the present invention;

FIG. 2 is a side perspective view of the sanitary door opener of the present invention;

FIG. 3 is a side perspective view of an alternate embodiment of the present invention wherein the sanitary door opener is adjustable;

FIG. 4 is a side perspective view of a second alternate embodiment of the present invention wherein the sanitary door opener is incorporated into a kick-plate design, FIG. 5 is a side view of a sanitary door opener of the present invention installed on a restroom door.

DETAILED DESCRIPTION

Figure 6:
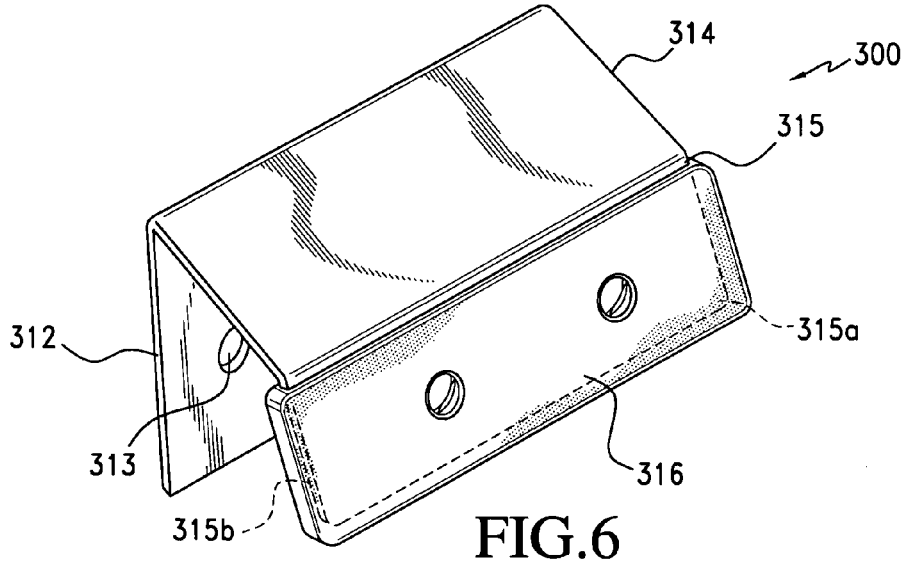
FIG. 6 is a side perspective view of a third alternate embodiment of the present invention wherein the sanitary door opener is mounted only to one side of a door.

The present invention relates to a sanitary door opener adapted to be installed on the bottom of a door in such a manner that a person can use his/her foot to pull the door open. Referring to FIGS. 1 and 2, a door D is shown having a bottom edge D1, a rear panel D2 and a front panel D3. Also shown is the sanitary door opener 10 of the present invention, comprising a bottom face 11, a rear face 12, a front face 13 and a top face 14 extending outwardly and at about a 90° angle (i.e. about perpendicularly) from rear face 12. The depth of bottom face 11 is configured to complement the bottom edge D1 of door D. Preferably, the depth of bottom face 11 is about 1¾" which is the standard depth of a conventional door. However, it is to be understood that the depth of the bottom face 11 can vary depending on the depth of the door. In this manner, the sanitary door opener 10 can be slid under an opened door such that rear face 12 contacts the door's rear panel D2, front face 13 contacts the door's front panel D3 and bottom face 11 contacts the bottom edge D1 of the door. Once the sanitary door opener 10 is disposed in the desired position, it can be mounted to the door D by a variety of means as will be well known to those skilled in the art. Preferably, apertures 16 are provided in rear face 12 and front face 13 such that the door opener can be screw-mounted to the door. It also is contemplated that the sanitary door opener can be secured to the door by adhesive or a combination of screw mounting and adhesive. Mounting the sanitary door opener to both the front and rear panels of the door ensures that the door opener is securely mounted to the door and will not become disengaged with the door due to extended use or wear and tear.

The sanitary door opener 10 of the present invention is composed of a strong and durable material which has some flexing ability. Preferably, the sanitary door opener is manufactured from a metal material. More preferably, the sanitary door opener is manufactured from brass or stainless steel. The sanitary door opener of the present preferably is manufactured from a single piece of material and is bent to form the several faces. However, it is to be understood that the sanitary door opener can be manufactured from more than a single piece of material without deviating from the present invention. Moreover, as will be obvious to those skilled in the art, the sanitary door opener of the present invention can be manufactured from a strong and durable non-metal material, including for example, plastics, fiberglass and even wood. Preferred non-metal materials are described hereinafter with reference to FIGS. 7 and 8.

Both the rear face 12 and front face 13 of the sanitary door opener can be configured of any desired width provided, of course, that the desired width is not greater than the width of the front and rear panels of the door. Preferably, the width of both the rear face and the front face of the sanitary door opener is between about four inches (4") and about twelve inches (12"), and more preferably between about four inches (4") and about six inches (6"), and most preferably about five and one-half inches (5½"). The height of the rear face 12 should be configured in such a manner that a person can engage the top face 14 with his/her shoe with ease and comfort. Preferably, the height of the rear face is between about four inches (4") and about eight inches (8"), more preferably between about five inches (5") and about six inches (6"), and most preferably about five and one-half inches (5½") which is a height adapted to accommodate the shoe of the average person. The front face 13 can be of the same height as the rear face 12 or can be of less height. Preferably, the front face is about two inches less (2") than the rear face, but should be no less than one and one-half inches (1½") in order to ensure secure mounting to the front panel D2.

Referring in particular to FIG. 2, in a preferred embodiment, top face 14 extends outwardly at about a 90° angle from the rear face 12 and is configured with a depth of between about two inches (2") and about four inches (4"), preferably about three inches (3"). The top face can be provided with a lip 15 having an upper surface 15*a* and an under surface 15*b*, the lip 15 extending downwardly and outwardly from the top face 14, preferably at an angle between about 45° and about 60°. The incorporation of the lip 15 enhances the engagement of the user's shoe with the sanitary door opener and aids in opening the door with the shoe. In addition, the extended top face and lip arrangement provide the sanitary door opener with a flexing ability to enhance the shoe's grip. The upper surface 15*a* and undersurface 15*b* preferably are provided with a gripping material, including for example rubber or rubber-like material, in order to prevent the shoe from sliding. The gripping material may be applied to the surface of the top face and lip by means well known in the art, including coating means, adhesive means or a plurality of binding screws that are recessed into the gripping material (thereby preventing the possibility of the user's shoe becoming scratched or caught on the screws). Preferably, the gripping material is in the form of a rubber pad which not only prevents the shoe from sliding, but also provides a cushioning effect if the door is opened onto the users foot or shin while the user is in the process of opening the door using the sanitary door opener of the present invention. In one embodiment, the rubber pad may be formed with a pocket which slides over the lip 15 such that both the upper surface and undersurface of the lip are covered.

In an alternate embodiment of the present invention, the depth of the sanitary door opener is adjustable. Referring now to FIG. 3, the sanitary door opener 100 comprises a bottom face 111 having a first portion 111*a* which is joined to rear face 112 and a second portion 111*b* which is joined to front face 113. First portion 111*a* is configured with a flange 116 at each end such that second portion 111*b* slides between the flanges. In this manner, the sanitary door opener 100 can be adjusted to accommodate doors of varying depths.

In a second alternate embodiment of the present invention, the sanitary door opener is designed as a kick-plate. Referring now to FIG. 4, the sanitary door opener 200 comprises a bottom face 211, a rear face 212, a front face 213, a top face 214 and a lip 215. The rear face 212 is configured with a width approximating but not exceeding the width of a door. Preferably, the rear face has a width of about thirty inches (30"). The height of the rear face 212 can be the same as that of rear face 12 discussed in reference to FIG. 2. By providing a wide rear face, the rear face of the sanitary door opener also serves as a kick plate. Top face 214 can be the same width as the rear face or can be configured with a lesser width sufficient to provide a shoe grip to pull open the door. The front face 213 of the sanitary door opening can be configured to be of the same width as the rear face 212 or of a lesser width as desirable.

FIG. 5 shows the sanitary door opener 10 of the present invention installed on a typical public restroom door and in particular the engagement of a shoe within the top face 14/lip 15 arrangement to facilitate opening the restroom door.

Referring now to FIG. 6, another alternate embodiment of the sanitary door opener of the present invention is shown.

In this embodiment, the sanitary door opener 300 is mounted only to one side of a door. More particularly, the sanitary door opener 300 comprises a rear face 312, a top face 314 which extends outwardly at about a 90° angle from the rear face and a lip 315 extending downwardly and outwardly from the top face 14, preferably at an angle between about 45° and about 60°. The rear face, top face and elements having similar dimensions to the sanitary door opener 10 shown in FIG. 2. The rear face 312 is provided with one or more apertures 313 to screw mount the sanitary door opener 300 to a door.

A rubber pad 316 is secured to the upper surface 315*a* and undersurface 315*b* of the lip 315. Preferably, a rubber pad 316 is mounted to each of the upper and undersurfaces of the lip 315 by the use of binding screws, the male portion of which being recessed within the rubber pad secured to the upper surface 315*a* and the female portion of which being secured within the rubber pad secured to the undersurface 315*b*. Alternatively, the rubber pad may be formed with a pocket which slides over the lip 315 as described above. The sanitary door opener 300 can be composed from any durable material as discussed above with respect to sanitary door opener 10. Preferably, the sanitary door opener is composed of a one-piece metal material, for example stainless steel, which is bent in order to form the rear face, top face and lip elements.

Figure 7:
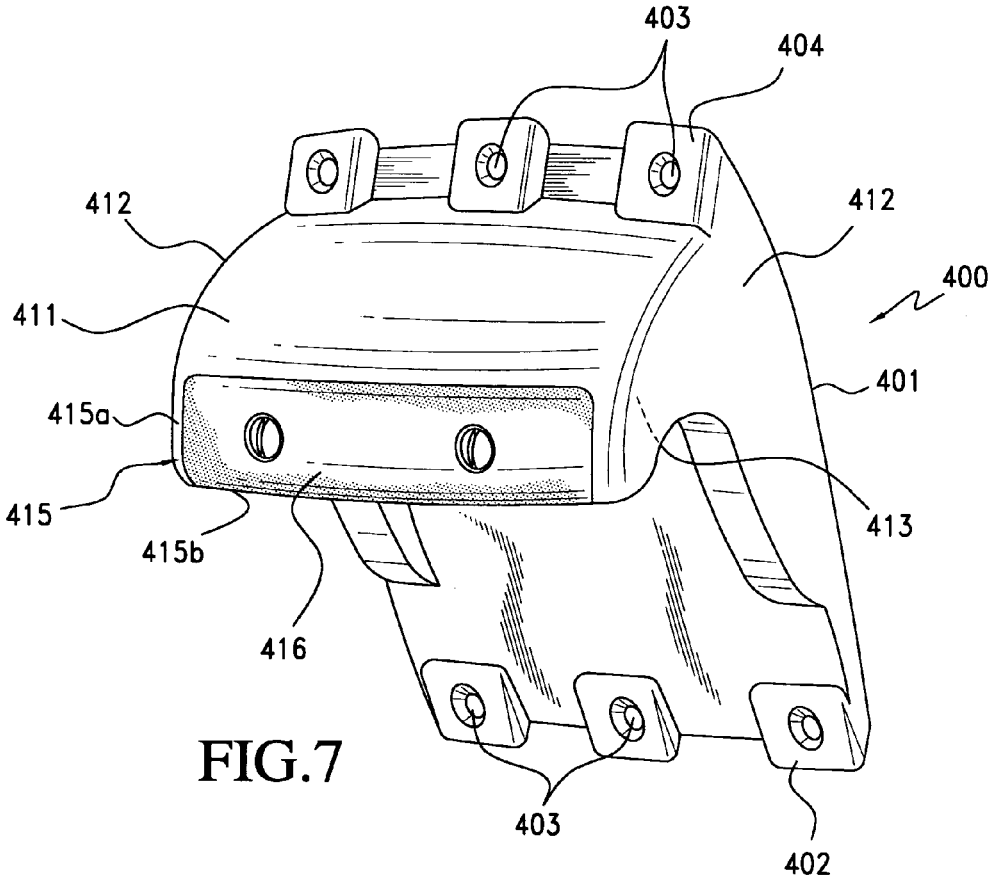
FIG. 7 is a side perspective view of a fourth alternate embodiment of the present invention wherein the sanitary door opener is formed by extrusion molding.
Figure 8:
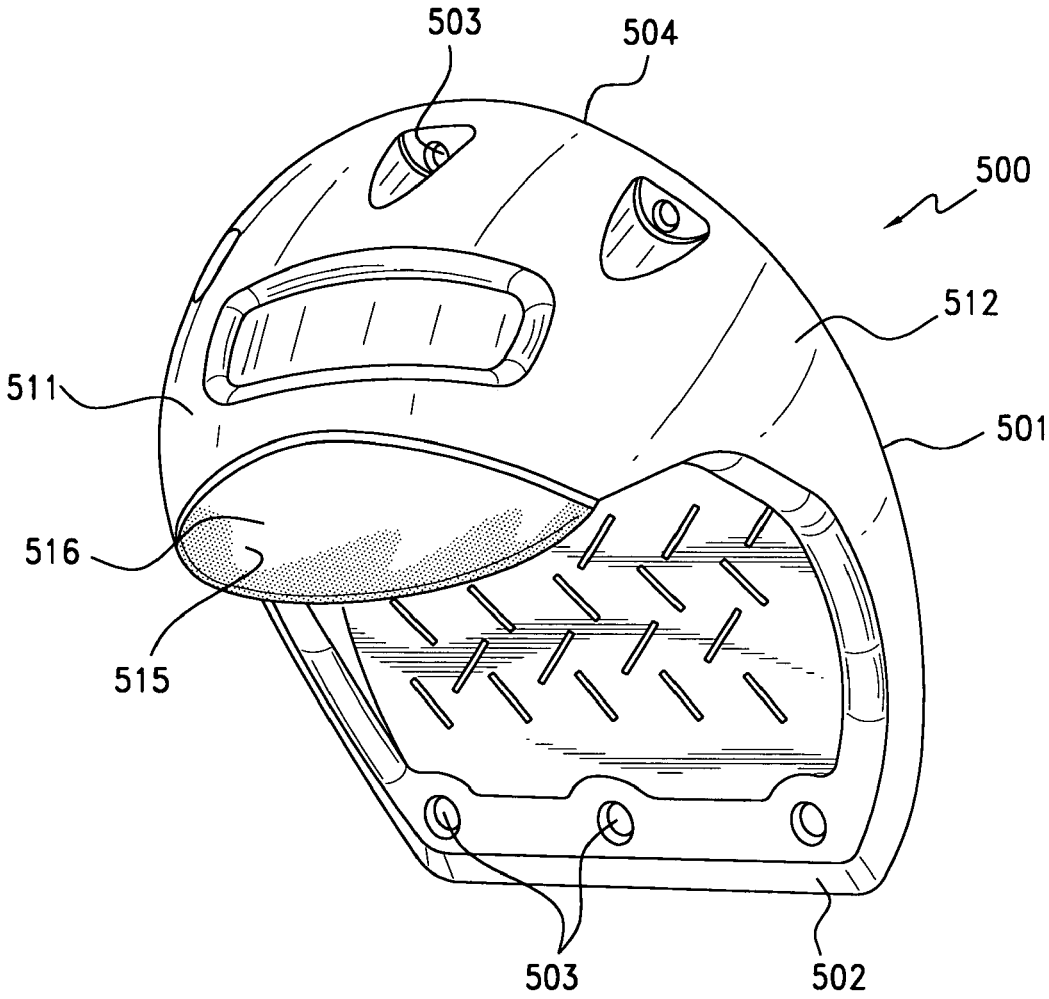
FIG. 8 is a side perspective view of a fifth alternate embodiment of the present invention wherein the sanitary door opener is formed by extrusion/injection molding.

FIGS. 7 and 8 also depict sanitary door openers which are mounted only to one side of a door. These door openers preferably are composed of a non-metal material and more preferably are composed of a durable plastic material. Suitable examples of such durable plastic materials include polyethylenes, polypropylenes, ethylene-propylene copolymers, polystyrenes, polyvinylchlorides, acrylonitrile-butadiene-styrene copolymers such as Dupont's Cycolac™ ABS copolymers, polycarbonates, such as GE Plastics Lexan™ polycarbonates, nylons, such as Dupont's Zytel™ nylon, glass or mineral-filled nylons, such as Dupont's Minlon™ nylon resins, polybutylene terephthalate copolymers, such as GE Plastics Valox™ PBT resins, polytetrafluoroethylenes (PTFE), copolymers of ABS and PTFE, such as GE Plastics Cycoloy™, PTFE—acetal resins, such as Dupont's Delrin™ resins, Advanced Elastomer Systems' Santoprene™ and mixtures thereof. Other non-metal materials include for example, neoprenes (hard rubber materials), graphites and wood. It will be apparent to those skilled in the art that these non-metal materials are merely examples of suitable materials and other durable plastic materials are contemplated to be within the scope of the present invention.

Referring now to FIG. 7, a sanitary door opener 400 is shown which preferably is manufactured as a one-piece form by extrusion molding. The sanitary door opener 400 comprises a rear wall 401 having a bottom edge 402 into which is formed at least one aperture 403, a top edge 404 into which is formed at least one aperture 403, an arcuate front wall 411 extending outwardly and downwardly from the top edge 403 of the rear wall and two side walls 412 joining said rear wall 401 and arcuate front wall 411. The height of the rear wall (that is, the distance from the top edge to the bottom edge) is between about four inches (4") and about eight inches (8"), more preferably between about five inches (5") and about six inches (6"), and most preferably about five and one-half inches (5½") which is a height adapted to accommodate the shoe of the average person. The arcuate front wall 411 is configured to extend outwardly and downwardly from the top edge of the rear wall and terminate into a front flange 415 and is dimensioned to be about half the height of the rear wall 401. Since the arcuate front wall extends outwardly and downwardly from the top edge of the rear wall, a cavity is created between the rear wall and front wall, this cavity being bound on either side by side walls 412 and being adapted to receive the toe-end of an average shoe. In this manner, a person can insert the toe-end of his shoe into the cavity such that the top of his shoe is in contact with the underside 413 of the front wall and then by pulling the inserted shoe toward him can open the door.

The front flange 415 corresponds to the lip 315 of the sanitary door opener 300 and is provided to enhance the engagement of the user's shoe with the sanitary door opener and aids in opening the door with the shoe. In addition, the arcuate front wall and flange arrangement provide the sanitary door opener with a flexing ability to enhance the shoe's grip. The outer surface 415*a* and undersurface 415*b* of the front flange preferably are provided with a gripping material, such as a rubber pad 416 which is mounted to each of the outer and under surfaces of the lip 415 by the use of binding screws as discussed above. Alternatively, the gripping material, such as a rubber composition a preferred example of which is Santoprene™, can be over-molded onto the outer surface and undersurface of the lip 415 during the manufacturing process. As discussed above, the rubber pad 416 may be formed with a pocket which slides over the lip 415 such that both the outer surface and undersurface of the lip are covered. The incorporation of the rubber pads not only prevents the shoe from sliding out of the cavity, but also provides a cushioning effect if the door is opened onto the users foot or shin while the user is in the process of opening the door using the sanitary door opener of the present invention.

Preferably each of the bottom edge and top edge of the rear wall 401 is formed with at least two apertures and each can be formed with three or more apertures. These apertures 403 are provided to facilitate the secure mounting of the sanitary door opener 400 to a door by means of screws.

FIG. 8 shows a sanitary door opener 500 which also is manufactured as a one-piece element from a non-metal material. Sanitary door opener 500 operates in the same manner as sanitary door opener 400 but has rounded edges in order to provide a softer, more aesthetic look. Referring to FIG. 8, the sanitary door opener 500 comprises a rear wall 501 having a rounded bottom edge 502 into which is formed at least one aperture 503, a rounded top edge 504 into which is formed at least one aperture 503, a rounded arcuate front wall 511 extending outwardly and downwardly from the rounded top edge 503 of the rear wall and two rounded side walls 512 joining said rear wall 501 and arcuate front wall 511. The rounded arcuate front wall 511 is configured to extend outwardly and downwardly from the top edge of the rear wall and terminate into a rounded front flange 515 and is dimensioned to be about half the height of the rear wall 501. A rubber pad 516 or other gripping material can be secured to the rounded front flange 515 in order to achieve the same cushioning effects as discussed above. The apertures 503 are provided to screw mount the sanitary door opener 500 to a door.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A sanitary door opener adapted to be mounted to a door having a bottom edge, a front panel and a rear panel, said sanitary door opener comprising (a) a bottom face having a depth corresponding to the depth of said bottom edge of said door; (b) a front face; (c) a rear face; (d) a top face extending outwardly from said rear face, and (e) a lip having an undersurface and an upper surface, the lip extending downwardly an outwardly at an angle of between about 45° and about 60° from said top face, wherein, said sanitary door opener is installed onto said door by sliding said door opener under said door such that said bottom face contacts said bottom edge, said front face contacts said front panel and said rear face contacts said rear panel, and securing said front face to said front panel and said rear face to said rear panel.

2. The sanitary door opener in accordance with claim 1 wherein said sanitary door opener is manufactured from a single sheet of material.

3. The sanitary door opener in accordance with claim 1, wherein said undersurface and said upper surface of said lip are provided with a gripping material.

4. The sanitary door opener in accordance with claim 1, wherein said bottom face is comprised of a first portion joined to said rear face and a second portion joined to said front face, said first portion adapted to engage said second portion in such a manner that the depth of said bottom face is adjustable.

5. The sanitary door opener in accordance with claim 1, wherein said rear face is configured with a width which corresponds to the width of said rear panel, thereby conforming said rear face to a conventional kick plate.

6. A sanitary door opener adapted to be mounted to a door having a bottom edge, a front panel and a rear panel, said sanitary door opener comprising (a) a bottom face having a depth corresponding to the depth of said bottom edge of said door;

(b) a front face having a width between about four inches (4") and about eight inches (8");

(c) a rear face having a width between about four inches (4") and about eight inches (8");

(d) a top face extending outwardly from said rear face, said top face having a width of between about two inches (2") and about four inches (4"), and (e) a lip extending outwardly and downwardly at an angle of between about 45° and about 60° from said top face, said lip having the same width as said top face;

wherein, said sanitary door opener is installed onto said door by sliding said door opener under said door such that said bottom face contacts said bottom edge, said front face contacts said front panel and said rear face contacts said rear panel, and securing said front face to said front panel and said rear face to said rear panel.

7. The sanitary door opener in accordance with claim 6, wherein said sanitary door opener is manufactured from a single sheet of material.

8. The sanitary door opener in accordance with claim 6, wherein said lip has an undersurface and an upper surface, said undersurface and said upper surface being provided with a gripping material.

9. The sanitary door opener in accordance with claim 6, wherein said bottom face is comprised of a first portion joined to said rear face and a second portion joined to said front face, said first portion adapted to engage said second portion in such a manner that the depth of said bottom face is adjustable.

10. A sanitary door opener adapted to be mounted to a door, said sanitary door opener comprising:

(a) a rear face provided with at least one aperture;

(b) a top face extending outwardly from said rear face at about a 90° angle from said rear face;

(c) a lip extending downwardly and outwardly from said top face at an angle between about 45° and about 60° from said top face, said lip having an undersurface and an upper surface, and (d) a first rubber pad secured to said undersurface of said lip and a second rubber pad secured to said upper surface of said lip, wherein said sanitary door opener is screw mounted to a door through said at least one aperture in such a manner that a user can guide the toe-end of his foot between the rear face, top face and undersurface of said lip and pull against the undersurface of said lip in order to open a door.

11. The sanitary door opener in accordance with claim 10, wherein said sanitary door opener is manufactured from a single sheet of material.

12. The sanitary door opener in accordance with claim 10, wherein said first and second rubber pads are replaced with a single rubber pad element having a pocket which is configured to slide over said lip.

13. A sanitary door opener adapted to be mounted to a door, said sanitary door opener comprising:

(a) a rear wall having a top edge provided with at least one aperture and a bottom edge provided with at least one aperture;

(b) an arcuate front wall extending outwardly and downwardly from said top edge of said rear wall and terminating into a front flange having an undersurface and an upper surface, said arcuate front wall dimensioned to be about half the height of said rear wall;

(c) two side walls joining said rear wall and said arcuate front wall;

(d) a lip extending downwardly and outwardly from said top face at an angle between about 45° and about 60° from said top face, said lip having an undersurface and an upper surface, and (e) a cavity disposed between said arcuate front wall, said rear wall and said two side walls, said cavity being adapted to receive the toe-end of a user's shoe, wherein said sanitary door opener is screw mounted to a door through said at least one aperture in said top and bottom edges in such a manner that a user can insert the toe-end of his foot inside said cavity and pull against the undersurface of said lip in order to open a door.

14. The sanitary door opener in accordance with claim 13, further comprising a first rubber pad secured to the undersurface of said front flange and a second rubber pad secured to the upper surface of said front flange.

15. The sanitary door opener in accordance with claim 13, further comprising a rubber pad having a pocket configured to slide over said lip.

16. The sanitary door opener in accordance with claim 13 wherein each of said rear wall, arcuate front wall, two side walls and front flange are provided with rounded edges.

17. The sanitary door opener in accordance with claim 13, wherein said sanitary door opener is composed of a durable plastic or resinous material.

18. The sanitary door opener in accordance with claim 17, wherein said durable plastic or resinous material is selected from the group consisting of polyethylene, polypropylene, ethylene-propylene copolymer, polystyrene, polyvinylchloride, acrylonitrile-butadiene-styrene copolymer, polycarbonate, nylon, glass or mineral-filled nylon, polybutylene terephthalate copolymer, polytetrafluoroethylene and mixtures thereof.

19. The sanitary door opener in accordance with claim 13, wherein said sanitary door opener is composed of a hard rubber material, graphite or wood.

20. The sanitary door opener in accordance with claim 13, wherein said sanitary door opener is manufactured as a one-piece form by extrusion/injection molding.

* * * * *